US007690359B2

(12) United States Patent
Price et al.

(10) Patent No.: US 7,690,359 B2
(45) Date of Patent: Apr. 6, 2010

(54) FLANGE-STRUT INTERFACE PERMITTING LOCATION SELECTION OF STRUTS

(75) Inventors: Gregory Edward Price, Oxford, MI (US); Matthias Nederegger, Rochester Hills, MI (US)

(73) Assignee: Continental Automotive Systems US, Inc., Auburn Hills, MI (US)

( * ) Notice: Subject to any disclaimer, the term of this patent is extended or adjusted under 35 U.S.C. 154(b) by 457 days.

(21) Appl. No.: 11/783,441

(22) Filed: Apr. 10, 2007

(65) Prior Publication Data

US 2007/0246928 A1 Oct. 25, 2007

Related U.S. Application Data

(60) Provisional application No. 60/791,934, filed on Apr. 13, 2006.

(51) Int. Cl.
*F02M 37/04* (2006.01)
*F02M 37/08* (2006.01)

(52) U.S. Cl. ..... 123/509

(58) Field of Classification Search ..... 123/509; 417/363, 448; 137/571; 280/830
See application file for complete search history.

(56) References Cited

U.S. PATENT DOCUMENTS 5,056,492 A * 10/1991 Banse ..... 123/509
5,680,847 A 10/1997 Begley et al.
5,762,049 A 6/1998 Jones et al.
6,260,543 B1 7/2001 Chih
6,890,190 B1 5/2005 Jurcak et al.
7,074,058 B2 7/2006 Jurcak et al.
7,168,416 B2 * 1/2007 Powell et al. ..... 123/509
7,520,270 B2 * 4/2009 Uhara ..... 123/509
2004/0168295 A1 9/2004 Jurcak et al.
2005/0166974 A1 8/2005 Hashiguchi

FOREIGN PATENT DOCUMENTS

DE 10021054 A1 12/2000
EP 1314604 A 5/2003
EP 1591294 A 11/2005

OTHER PUBLICATIONS

PCT Search Report and Written Opinion Sep. 20, 2007.

* cited by examiner

*Primary Examiner*—Mahmoud Gimie

(57) ABSTRACT

A flange assembly 23 of a fuel supply unit includes a flange 22 constructed and arranged to be mounted to a fuel tank and a strut support structure 18 separate from the flange. The support structure includes a body 20 and at least a pair of strut supports 30 integral with the body and disposed in spaced relation. Each strut support is constructed and arranged to engage and support a strut. The body 20 is coupled to the flange 22 at one of a plurality of possible orientations such that the strut supports 30 are located at one of a plurality of selectable positions with respect to the flange 22.

23 Claims, 7 Drawing Sheets

FLANGE-STRUT INTERFACE PERMITTING LOCATION SELECTION OF STRUTS

This application claims the benefit of the earlier filing date of U.S. Provisional Application No. 60/791,934, filed on Apr. 13, 2006, which is incorporated by reference herein in its entirety.

FIELD OF THE INVENTION

The invention relates to fuel supply units for automobile vehicles and more particularly, to strut mounting for connecting struts to a flange of the fuel supply unit.

BACKGROUND OF THE INVENTION

With reference to FIG. 1, a typical fuel supply unit for a vehicle includes a fuel flange 10 configured to be sealed to a wall of a fuel tank. The flange 10 is interconnected with a fuel pump assembly 12 by struts 14. Typically, strut supports are molded into the bottom of the flange. For example, with reference to FIG. 2, the bottom of a conventional flange 10' is shown having strut supports 16. The strut supports 16 affect the mold flow and can cause warpage.

Furthermore, customers are requiring flexibility regarding the position of a reservoir and level sender with respect to the flange location for in tank fuel supply units. One solution is to provide additional strut supports 16 on the bottom of the flange 10'. For example, as shown in FIG. 2, five struts supports are provided and the user can select certain of the struts supports to provide the desired strut mounting location. However, the additional strut supports 16 add material to the flange that is not needed for certain applications. In addition, the added strut supports 16 make the molding more complicated and it is difficult to achieve the required perpendicularity of the interfaces due to shrinkage. Still further, some strut support locations on the flange are not possible due to molding constraints although the flange bottom could accommodate such locations. In other applications, additional features or ports cannot be added to the flange due to an interference with the strut supports 16.

Accordingly, there is a need provide a simple structure for supporting struts that can be orientated in a flexible manner with respect to the flange.

SUMMARY OF THE INVENTION

An object of the invention is to fulfill the need referred to above. In accordance with the principles of the present invention, this objective is obtained by providing a strut support structure for supporting struts of a fuel supply unit. The strut support structure includes a body and at least a pair of strut supports integral with the body and disposed in spaced relation. Each strut support is constructed and arranged to engage and support a strut. The body is constructed and arranged to be selectively coupled to a flange of a fuel supply unit at one of a plurality of possible orientations such that the strut supports can be located at one of a plurality of selectable positions with respect to the flange.

In accordance with another aspect of the invention, a fuel supply assembly includes a flange constructed and arranged to be mounted to a fuel tank and a strut support structure separate from the flange. The support structure includes a body and at least a pair of strut supports integral with the body and disposed in spaced relation. A strut is coupled with the each strut support. A reservoir is associated with the struts and a level sender is provided. The body of the strut support structure is coupled to the flange at one of a plurality of possible orientations such that the strut supports and thus struts are located at one of a plurality of selectable positions with respect to the flange, thereby permitting selective orientation of the reservoir and level sender with respect to the flange.

In accordance with yet another aspect of the invention, a method of providing strut supports with respect to a flange of a fuel supply unit of a vehicle provides a flange of a fuel supply unit and a strut support structure having a body and at least a pair of strut supports integral with the body and disposed in spaced relation. Each strut support is constructed and arranged to engage and support a strut. The method couples the body to the flange at one of a plurality of possible orientations such that the strut supports are located at one of a plurality of selectable positions with respect to the flange.

Other objects, features and characteristics of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

BRIEF DESCRIPTION OF THE DRAWINGS

The invention will be better understood from the following detailed description of the preferred embodiments thereof, taken in conjunction with the accompanying drawings, wherein like reference numerals refer to like parts, in which.

DETAILED DESCRIPTION OF THE EXEMPLARY EMBODIMENT

Figure 3:
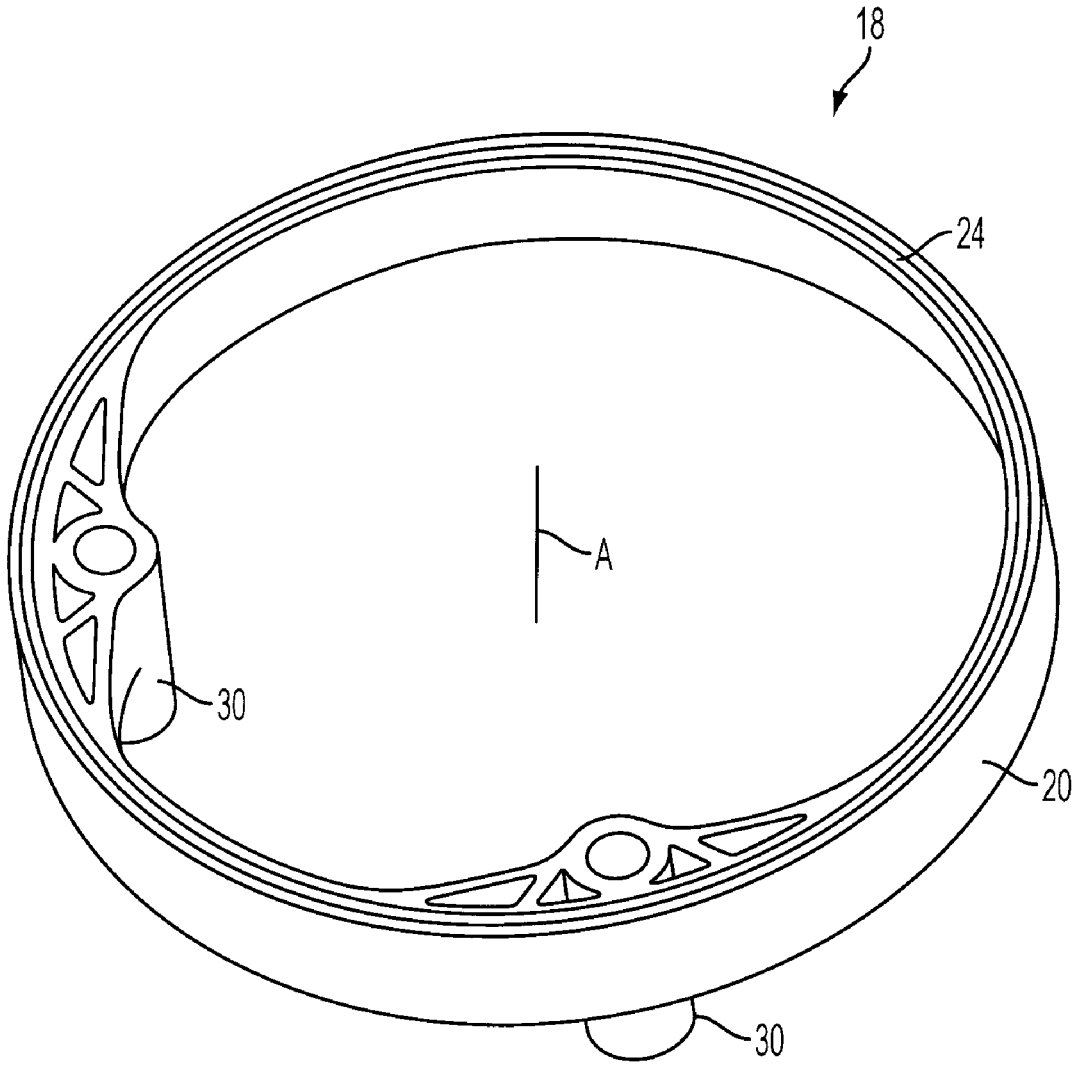
FIG. 3 is a perspective view of a strut support structure provided in accordance with an embodiment of the invention.
Figure 4:
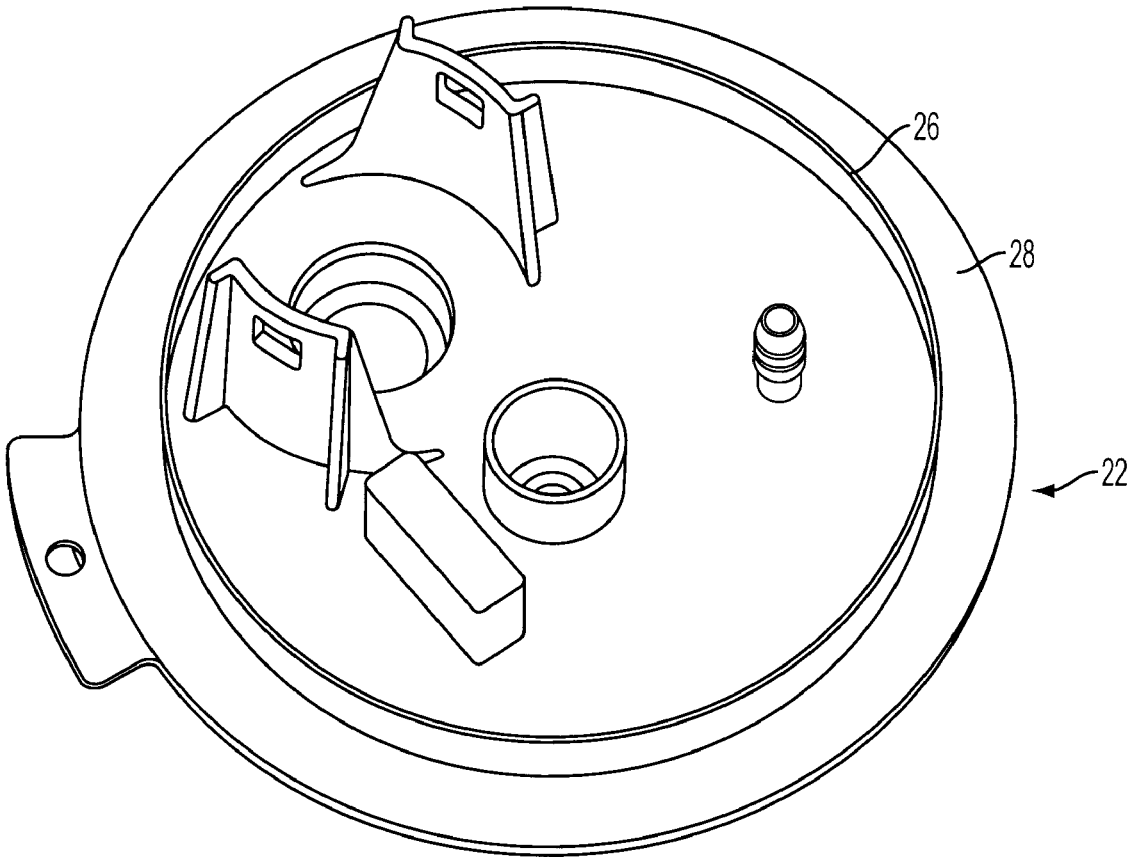
FIG. 4 is a perspective view of a bottom of a flange for receiving the strut support structure of FIG. 2.
Figure 5:
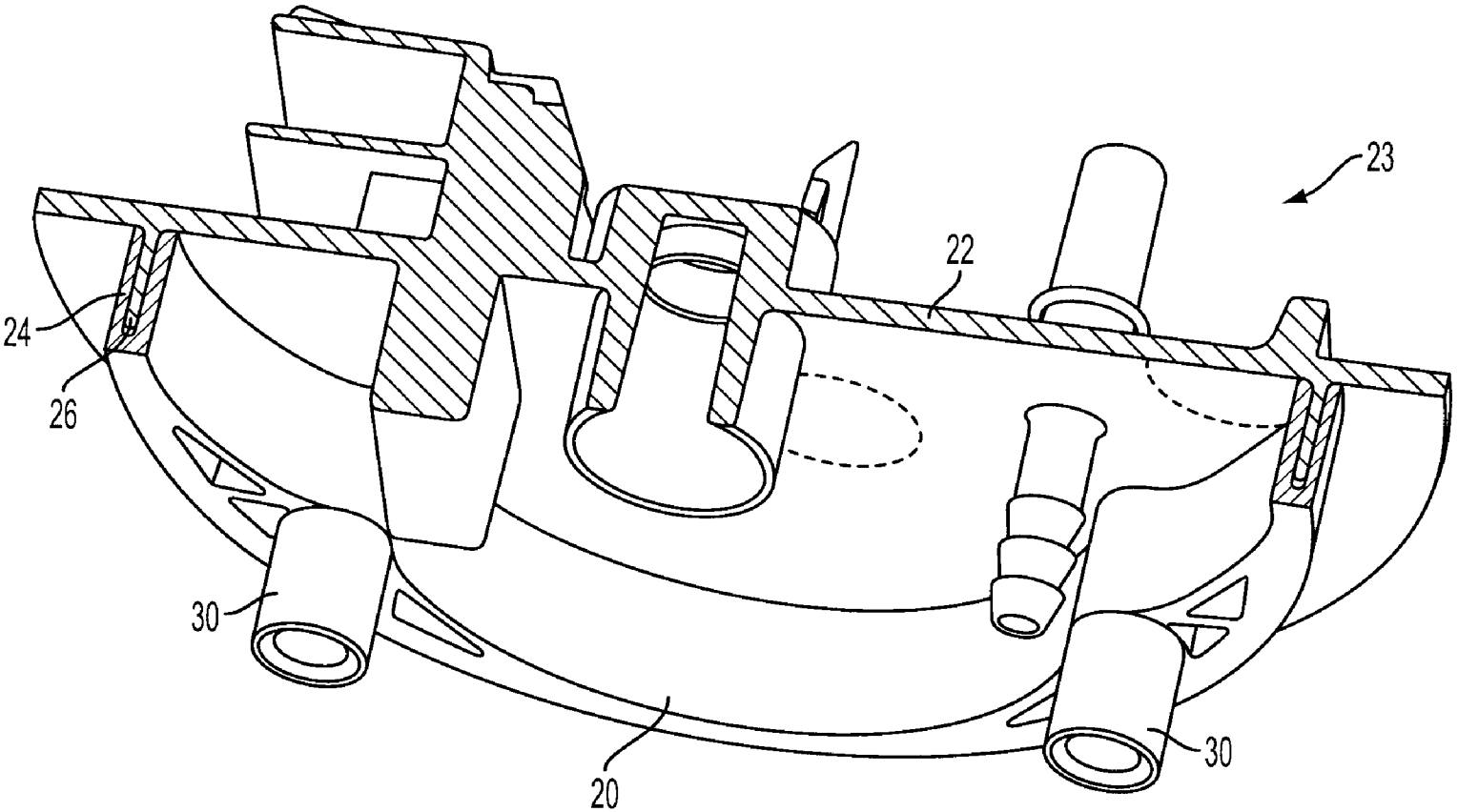
FIG. 5 is a sectional view of the strut support structure of FIG. 2 coupled with the flange of FIG. 4.
Figure 6:
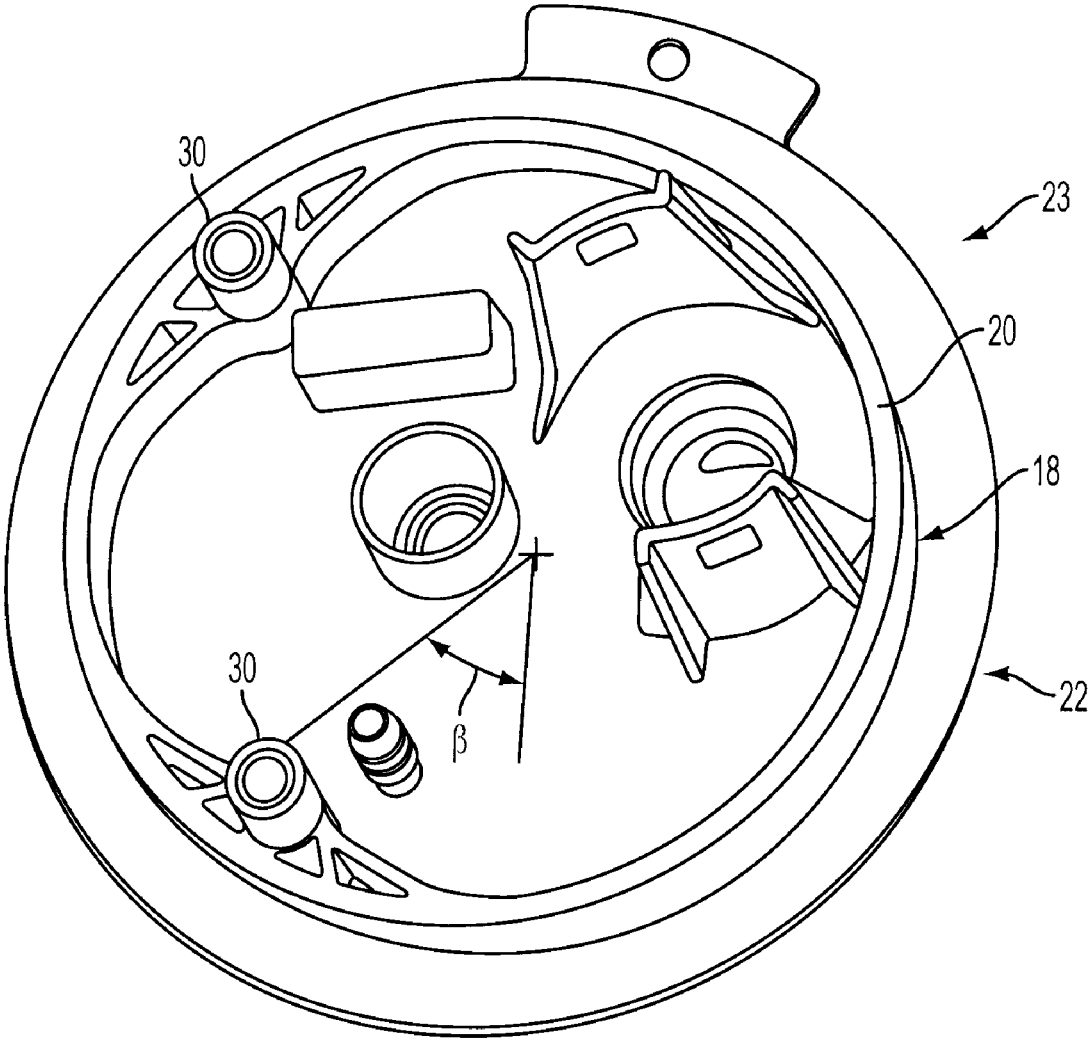
FIG. 6 is a perspective view of a bottom of the flange of FIG. 4 shown with the strut support structure of FIG. 2 coupled therewith.

With reference to FIG. 3, a strut support structure is shown, generally indicated at 18, in accordance with an embodiment of the present invention. In the embodiment, the structure 18 has a ring-shaped body 20 constructed and arranged to be coupled with a flange, generally indicated at 22 in FIG. 4. In particular, in the illustrated embodiment, the body 20 includes flange mating structure in the form of a continuous, annular channel 24. The channel is constructed and arranged to receive, in press-fit relation, an annular lip structure extending from a bottom of the flange 22 as shown in FIG. 5 and 6. The strut support structure 18 coupled with the flange 22 defines a flange assembly, generally indicated at 23.

Figure 1:
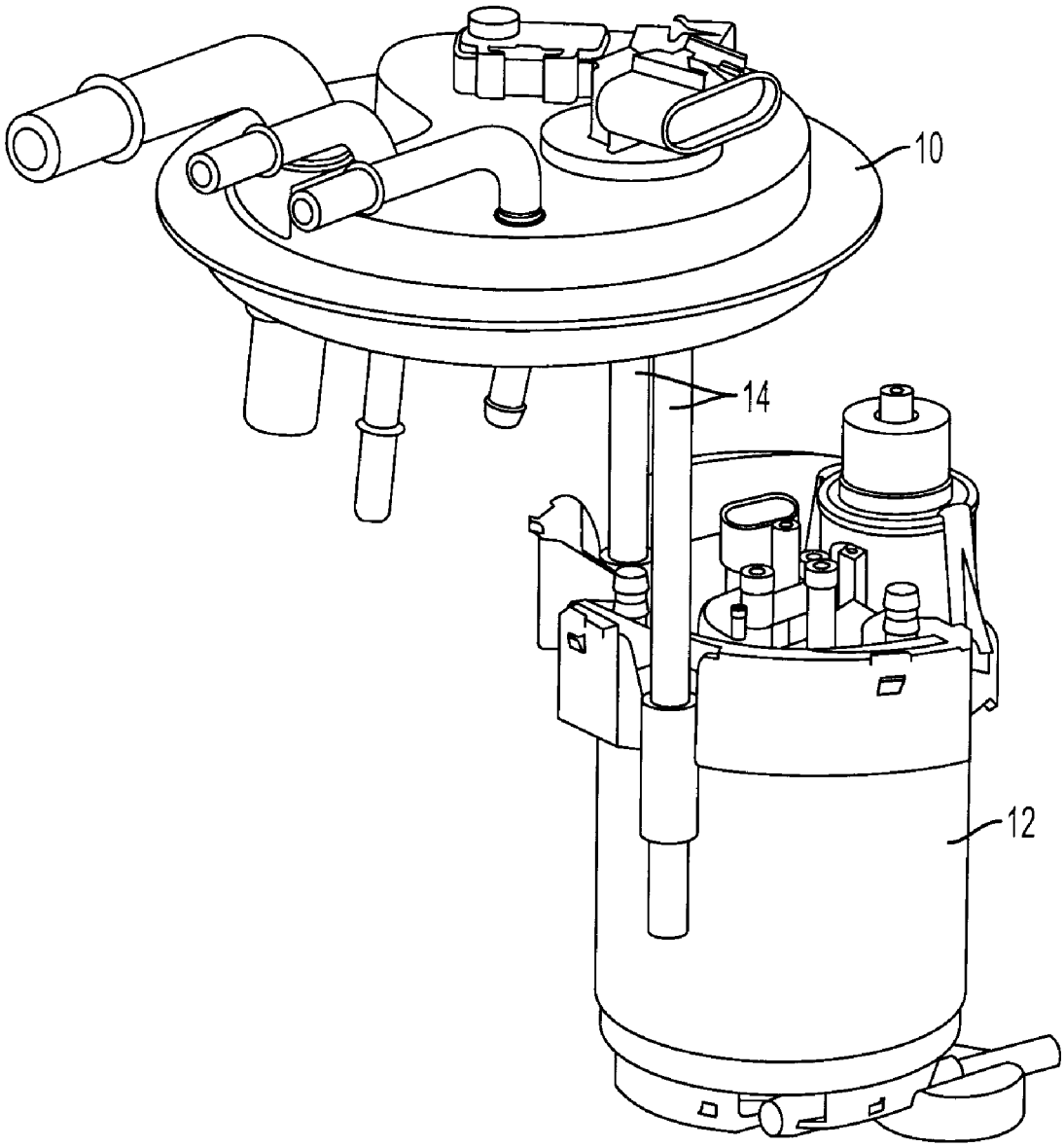
FIG. 1 PRIOR ART
FIG. 1 is a perspective view of a conventional fuel supply unit showing a flange connected with a fuel pump via struts.
Figure 2:
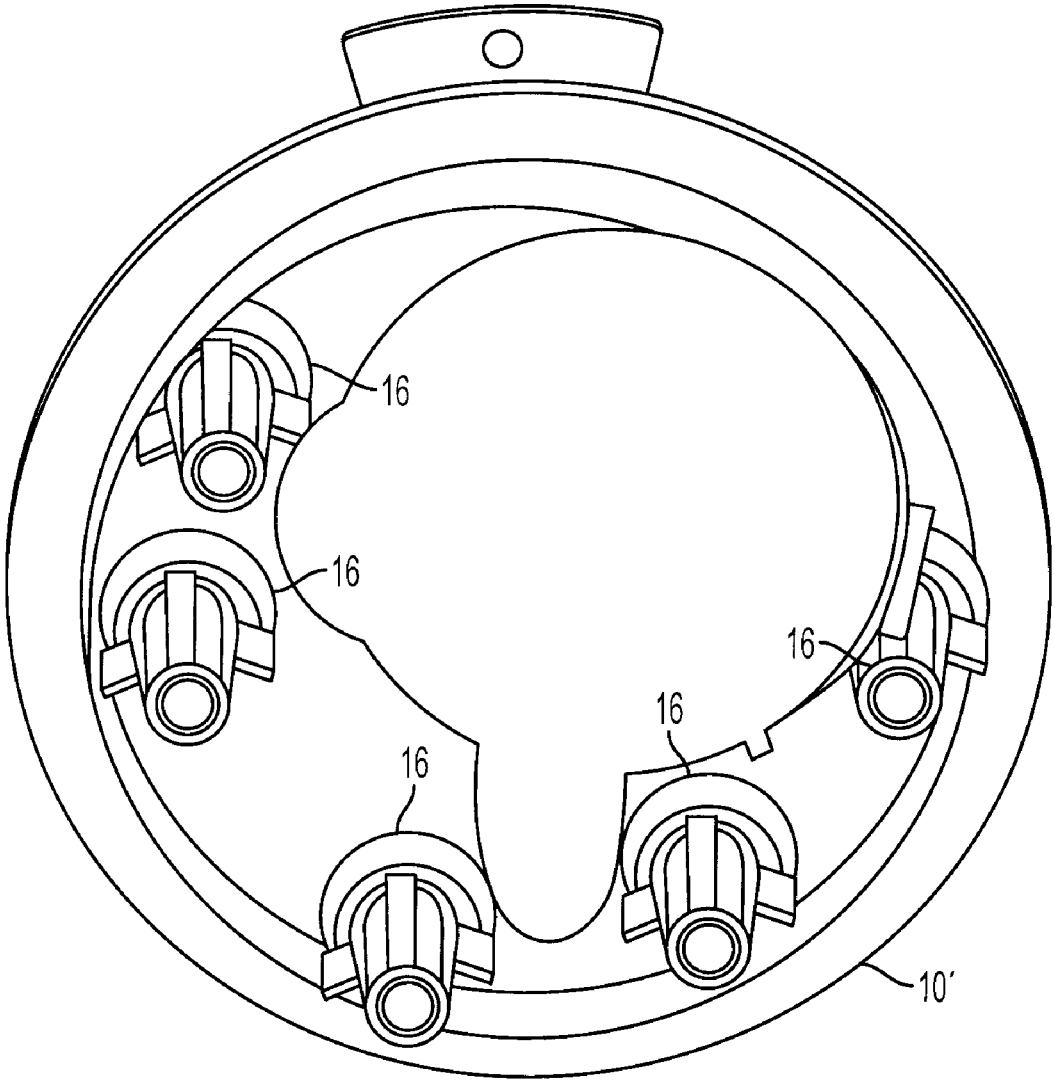
FIG. 2 PRIOR ART
FIG. 2 is a perspective view of a bottom of a conventional flange of fuel supply unit showing strut supports.

With reference to FIG. 2, the strut support structure 18 includes at least a pair strut supports 30 integral with the body 20 and disposed in spaced relation within the bounds of the body 20. The strut supports 30 extend axially (in the direction of axis A) and are constructed and arranged to engage or receive a strut for mounting a fuel pump assembly or other structures in a fuel tank. For example, struts can be press-fitted with respect to the strut supports 30. The strut support structure 18 is preferably molded from plastic such as Polyoxymethylene (POM) or can be molded from metal. The flange 22 is preferably molded from the same material as the strut support structure 18. Alternatively, the strut support structure 18 can be composed of plastic and the flange 22 composed of metal, or the flange 22 can be composed of plastic with the strut support structure composed of metal.

Figure 7:
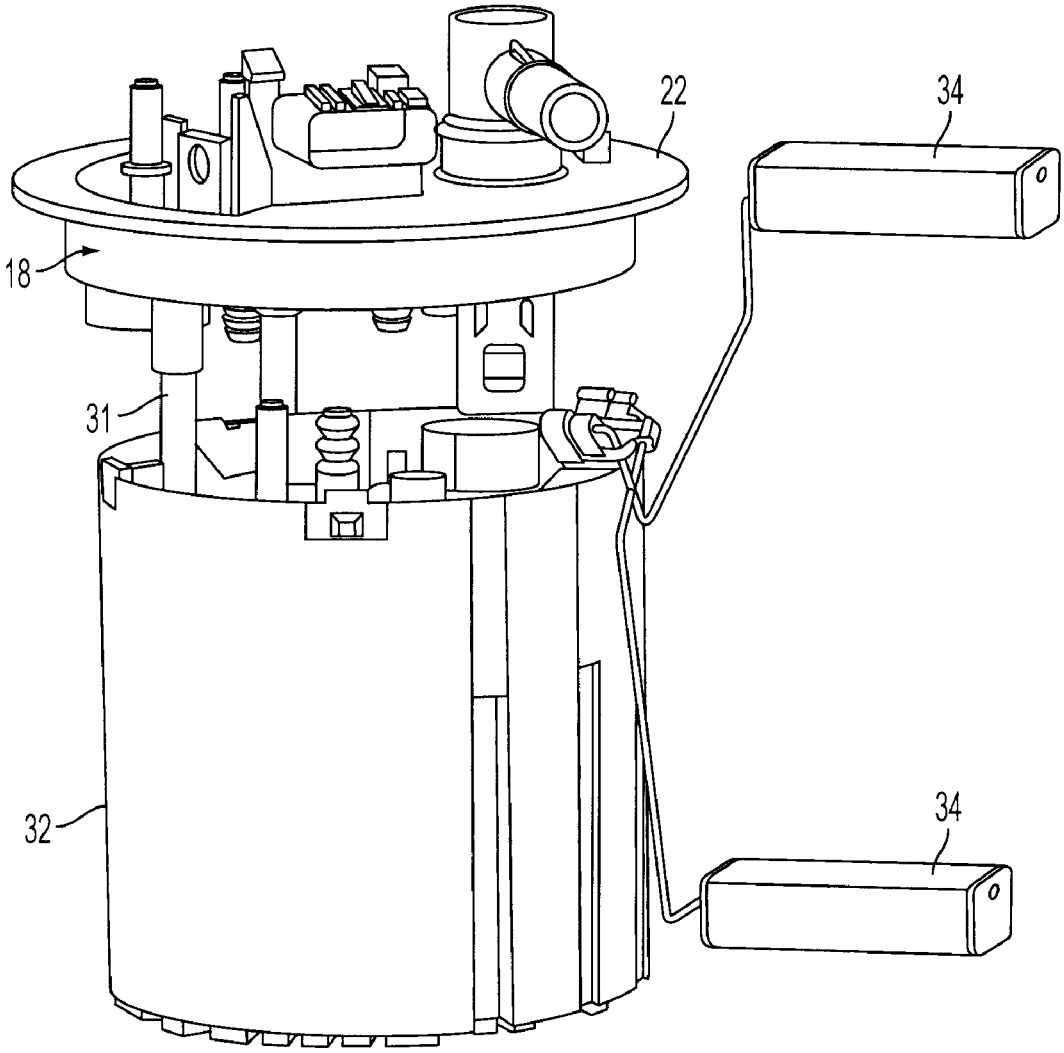
FIG. 7 is a view of the flange and strut support structure of FIG. 6 shown in relation to a reservoir and level senders.

Since the strut support structure 18 can be mounted to the lip structure 26 at any angular location (e.g., see angle B in FIG. 6) with respect to the flange 22, flexible or selectable mounting can be accomplished. Thus, with reference to FIG. 7, since the strut support structure 18 can be mounted at any position along the full 360 degrees of the flange 22, when the struts 31 are coupled with the strut support structure 18 and with the reservoir 32, the orientation of the reservoir 32 and level senders 34 with respect to the location of the flange 22 can be selected.

In addition, molding of the flange 22 and the strut support structure 18 is simplified. The number of strut supports 30 and the spacing there-between depends on the application.

A potential cost increase due to the additional labor to assemble the strut support structure 18 to the flange 22 can be compensated by reduced cycle time for the molding of the flange 22. In order to create a flange with an acceptable flatness/warpage, the flange needs to be "cooled" in the mold. During this process, the mold is utilized as a cooling gage. Since the molded flange 22 is less complex than the conventional flange due to not requiring strut supports, the cycle time can be reduced.

By using the separate strut support structure 18, additional features can be added to either the flange 22 or the strut support structure 18 that could not be included in the conventional flange due to molding constraints.

Although the strut support structure 18 is shown to be of ring shape, it can be appreciated that the structure 18 can be of arc shape and still be able to be mounted to the lip structure 26 at any position along the circumference of the lip structure 26. In addition, instead of press-fitting the strut support structure 18 to the flange 22 by using the channel and lip structure, other coupling techniques such as, for example, a snap-fit, or any type of welding operation can be employed.

The strut support structure 18 can be used with domed or non-domed flanges.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. A strut support structure for supporting struts of a fuel supply unit, the strut support structure comprising:

a body, and at least a pair of strut supports integral with the body and disposed in spaced relation, each strut support being constructed and arranged to engage and support a strut, wherein the body is constructed and arranged to be selectively coupled to a flange of a fuel supply unit at one of a plurality of possible orientations such that the strut supports can be located at one of a plurality of selectable positions with respect to the flange.

2. The structure of claim 1, wherein the body is ring-shaped and the strut supports extend axially there-from.

3. The structure of claim 2, wherein the strut supports are disposed within bounds of the ring-shaped body.

4. The structure of claim 1, wherein the body is molded from plastic.

5. The structure of claim 1, wherein the body is molded from metal.

6. The structure of claim 1, in combination with the flange, flange being constructed and arranged to be mounted to a fuel tank of a vehicle, the flange having a bottom, the body being coupled with the bottom of the flange.

7. The combination of claim 3, wherein an annular lip structure extends from a bottom of the flange, the body being a ring-shaped having a continuous annular channel, the lip structure being received in the channel.

8. A fuel supply assembly comprising:

a flange constructed and arranged to be mounted to a fuel tank, a strut support structure separate from the flange, the strut support structure comprising:

a body, and at least a pair of strut supports integral with the body and disposed in spaced relation, a strut coupled with each strut support, a reservoir associated with the struts, and a level sender, wherein the body of the strut support structure is coupled to the flange at one of a plurality of possible orientations such that the strut supports and thus struts are located at one of a plurality of selectable positions with respect to the flange, thereby permitting selective orientation of the reservoir and level sender with respect to the flange.

9. The assembly of claim 8, wherein the body is ring-shaped and the strut supports extend axially there-from.

10. The assembly of claim 9, wherein the strut supports are disposed within bounds of the ring-shaped body.

11. The assembly of claim 8, wherein the body and the flange are molded from plastic.

12. The assembly of claim 8, wherein the body and the flange are molded from metal.

13. The assembly of claim 8, wherein the body is composed of metal and the flange is composed of plastic.

14. The assembly of claim 8, wherein the body is composed of plastic and the flange is composed of metal.

15. The assembly of claim 9, wherein the flange has a bottom, the body being coupled with the bottom of the flange.

16. The assembly of claim 15, wherein an annular lip structure extends from the bottom of the flange, the body having a continuous annular channel, the lip structure being received in the channel.

17. A method of providing strut supports with respect to a flange of a fuel supply unit of a vehicle, the method comprising the steps of:

providing a flange of a fuel supply unit, providing a strut support structure having a body and at least a pair of strut supports integral with the body and disposed in spaced relation, each strut support being constructed and arranged to engage and support a strut, and coupling the body to the flange at one of a plurality of possible orientations such that the strut supports are located at one of a plurality of selectable positions with respect to the flange.

18. The method of claim 17, wherein the body is ring-shaped having a continuous annular channel therein and the flange has an annular lip structure extending from a bottom thereof, the coupling step including inserting the lip structure into the channel so that the lip structure is in press-fit relation with the body.

19. The method of claim 17, wherein each of the flange and the strut support structure is molded from plastic.

20. The method of claim 17, wherein each of the flange and the strut support structure is molded from metal.

21. The method of claim 17, wherein the strut support structure is composed of metal and the flange is composed of plastic.

22. The method of claim 17, wherein the strut support structure is composed of plastic and the flange is composed of metal.

23. The method of claim 17, further providing a reservoir and a level sender, the method further including coupling struts to the strut supports and to the reservoir thereby enabling selective orientation of the reservoir and level sender with respect to the flange.

* * * * *